US006139225A

United States Patent [19]

Koike et al.

[11] Patent Number: 6,139,225

[45] Date of Patent: Oct. 31, 2000

[54] METHOD FOR BUILDING AN UNDERGROUND CONTINUOUS WALL

[75] Inventors: Kenji Koike; Yoshiaki Inagaki, both of Matsudo; Minoru Aoi, Chiyoda-ku; Fumio Kinoshita, Chiyoda-ku; Shigeki Ashida, Chiyoda-ku; Yuji Nakajima; Tatsuo Komoto, both of Akashi; Hiroaki Kondo, Osaka, all of Japan

[73] Assignee: Kabushiki Kaisha Kobe Seiko Sho, Kobe, Japan

[21] Appl. No.: 08/894,085

[22] PCT Filed: Dec. 13, 1996

[86] PCT No.: PCT/JP96/03647

§ 371 Date: Aug. 13, 1997

§ 102(e) Date: Aug. 13, 1997

[87] PCT Pub. No.: WO97/21877

PCT Pub. Date: Jun. 19, 1997

[30] Foreign Application Priority Data

Dec. 13, 1995 [JP] Japan ..... 7-324753
May 27, 1996 [JP] Japan ..... 8-132362

[51] Int. Cl.[7] ..... E02D 5/18; E02D 29/00

[52] U.S. Cl. ..... 405/267; 405/55; 405/266; 37/352; 37/353; 37/464

[58] Field of Search ..... 405/266, 267, 405/129, 55, 138, 181, 268; 37/189, 462, 464, 352, 354, 94, 388, 353

[56] References Cited

U.S. PATENT DOCUMENTS

| | | | |
|---|---|---|---|
| 3,024,546 | 3/1962 | Cramer | 37/352 |
| 3,768,266 | 10/1973 | Glenn | 405/17 |
| 3,800,544 | 4/1974 | Nakanishi | 405/266 |
| 3,986,280 | 10/1976 | Johnson | 405/267 X |
| 3,990,250 | 11/1976 | Howard | 405/266 |
| 4,090,363 | 5/1978 | List et al. | 405/109 |
| 4,164,082 | 8/1979 | Watson | 37/353 |
| 4,379,658 | 4/1983 | Schmednecht | 405/267 |
| 4,648,743 | 3/1987 | Sauer | 405/138 |
| 4,666,336 | 5/1987 | Murakami et al. | 405/138 |
| 4,681,483 | 7/1987 | Camilleri | 405/267 |
| 4,871,281 | 10/1989 | Justice | 405/181 |
| 4,877,358 | 10/1989 | Ressi Di Cervia | 405/267 |
| 5,074,063 | 12/1991 | Vannette | 37/191 A |
| 5,112,161 | 5/1992 | Trevisani | 405/267 |
| 5,127,771 | 7/1992 | Wind | 405/266 X |
| 5,497,567 | 3/1996 | Gilbert | 37/352 |
| 5,601,383 | 2/1997 | Zanin | 405/154 |
| 5,701,692 | 12/1997 | Woodall | 37/353 |
| 5,722,800 | 3/1998 | Esters | 405/267 |
| 5,791,825 | 8/1998 | Gardner et al. | 405/267 |

FOREIGN PATENT DOCUMENTS

| | | |
|---|---|---|
| 0 188 282 | 7/1986 | European Pat. Off. . |
| 0 577 430 | 1/1994 | European Pat. Off. . |
| 36 21 884 | 1/1987 | Germany . |
| 5-280043 | 10/1993 | Japan . |
| 5-280044 | 10/1993 | Japan . |

*Primary Examiner*—Eileen D. Lillis
*Assistant Examiner*—Jong-Suk Lee
*Attorney, Agent, or Firm*—Oblon, Spivak, McClelland, Maier & Neustadt, P.C.

[57] ABSTRACT

An underground continuous wall building method and apparatus in which a chain cutter 2 provided with excavation blades is obliquely mounted on a running carriage 1. Slanting continuous trenches G1, G2 are excavated by moving the running carriage 1 in a transverse direction while rotating the cutter 2 with the cutter 2 obliquely placed in the ground, and a water cutoff material is poured into the excavated continuous trenches G1, G2 and solidified therein to build slanting continuous walls R1, R2 in the ground.

9 Claims, 11 Drawing Sheets

METHOD FOR BUILDING AN UNDERGROUND CONTINUOUS WALL

BACKGROUND OF ART

1. Field of the Invention

The present invention relates to underground continuous wall building method and apparatus for building a variety of continuous walls in the ground for water cutoff purpose, reinforcing purpose and other purposes.

2. Description of Background Art

As a technique for building an underground continuous wall, there has been conventionally known a method according to which a chain cutter is vertically mounted on a running carriage (e.g. a base machine of a crawler crane), the running carriage is moved in a transverse direction while the cutter is rotated, thereby excavating a continuous trench of a fixed width, and a continuous wall is built by pouring a wall material such as cement or concrete into this continuous trench and solidifying it therein or by inserting a concrete panel therein (refer to Japanese Unexamined Patent Publication Nos. 5(HEI)-280043 and 5(HEI)-280044.

The cutter is constructed such that an endless chain is fitted between upper and bottom ends of a cutter post which is a vertically long boxlike frame, and a continuous trench Gis excavated by a multitude of excavating blades provided at the outer surface of the chain.

However, according to this technique, only vertically extending continuous walls can be built. Therefore, such walls cannot have a water cutoff function along vertical direction as cutoff walls, but can only be used as cutoff walls along horizontal direction.

Thus, in the case that a water cutoff function along vertical direction is required, the ground must be filled up after being excavated to built a horizontal cutoff wall or a vertical wall must be built up to an impermeable bed. However, such techniques are poor in performance and high in cost.

SUMMARY OF THE INVENTION

Accordingly, it is an object of the present invention to provide underground continuous wall building method and apparatus which are capable of easily building a cutoff wall having a water cutoff function along vertical direction as well as multi-purpose underground continuous walls.

It is another object of the present invention to provide an underground continuous wall building method which, in the case that a protection wall for a river bank or the like is to be built, is capable of maintaining natural views while keeping a bank slope intact; keeping the bank as natural as possible even if the bank protection wall is exposed due to a washout; effecting an easy evacuation at the time of the rise of water; and enabling a construction work to be continued even during a flooding period.

It is still another object of the present invention to provide an underground continuous wall building method which is capable of displaying a high slip destruction preventing effect in the case that a reinforcement wall is build to prevent a slip destruction of an already existing embankment.

It is further another object of the present invention to provide an underground continuous wall building apparatus capable of desirably adjusting an excavation angle according to the application of the continuous wall.

In order to solve the above problems, the invention adopts the following constructions.

According to the invention a chain cutter in which an endless chain provided with excavation blades is fitted between upper and bottom ends of a cutter post is obliquely mounted on a running carriage; a continuous trench is excavated by moving the running carriage in a transverse direction while the cutter is rotated with the cutter obliquely placed in the ground; and a slanting continuous wall is built in the ground by pouring a wall material into the thus excavated continuos trench. Preferably, the slanting continuous trench is so excavated as to have a substantially triangular cross section and the wall material is poured into this continuous trench in order to build a slanting continuous wall which serves as a roof of an underground construction.

The slanting continuous trench may be excavated between vertical walls built in the ground and the wall material may be poured into this continuous trench in order to build a slanting continuous wall as an oblique wall for the reinforcement.

The slanting continuous trench may be so excavated as to extend over two vertical walls built at a specified spacing in the ground and the wall material may be poured into this continuous trench in order to build a slanting continuous wall which serves as a cutoff bottom wall for preventing the entry of water into the region between the two vertical walls from below.

The slanting continuous trench may be continuously excavated in a zigzag manner and the wall material may be poured into this continuous trench in order to build a slanting continuous wall as a zigzag continuous cutoff wall.

The slanting continuous trench may be excavated along a bank and the wall material may be poured into this continuous trench in order to build a slanting continuous wall along the bank.

The continuous trench may be excavated along the slope of a natural bank.

The continuous trench is excavated in at least one of a main portion and a foundation portion of an embankment built along the bank.

The a conical continuous trench may be excavated by moving the running carriage in circle and the wall material may be poured into this continuous trench in order to build a conical continuous wall which serves as a cutoff wall.

According to a further embodiment of the invention, an inverted conical continuous trench and a conical continuous trench may be excavated at the upper and lower sides of the underground in such a manner that the apices of the respective conical continuous trenches are in contact with each other, by moving the running carriage in circle with an intermediate point of a portion of the cutter placed in the ground set as a fixed point.

A building apparatus according to the present invention is characterized in that a chain cutter in which an endless chain provided with excavation blades is fitted between upper and bottom ends of a cutter post is inclinably mounted on a running carriage about a horizontal axis, and a backstay for adjusting an angle of the chain cutter is provided between the chain cutter and the running carriage.

A hydraulic cylinder may be used as the backstay.

With the above construction, since the slanting continuous wall can be built in the ground, the application of the continuous wall can be enhanced such as the use as a cutoff wall having a water cutoff function along vertical direction.

In this case, the continuous wall can be built as a roof of an underground construction such as a stockroom for radioactive wastes.

Alternatively or in addition, the continuous wall can be built as an oblique wall of an underground reinforcement in, e.g. a highly earthquake-resistance quay.

Furthermore, the continuous wall can be built as a water cutoff bottom wall for preventing the entry of groundwater into a trench excavated, e.g. to install a common trench for sewage piping and electricity piping in the ground where free-water elevation is high.

On the other hand, the continuous wall can be built as a cutoff wall, e.g. in the case that a ground liquefaction prevention area is built over a wide range.

Protection walls for banks of rivers or other watercourses, walls for preventing a leakage in already existing embankments, and reinforcement walls for preventing a slip destruction can be efficiently built with a fewer number of construction steps.

A bank protection wall for preventing a washout (erosion) can be built while maintaining a natural view by keeping the slope of a bank intact.

Even if the bank is washed out to expose the wall, since the wall is slanting, the bank can be kept as natural as possible.

Since a construction work can be done on the bank and a so-called coffering where the water of the river or the like is dammed up to enable a construction work on the inside of the bank is not necessary, evacuation at the time of the rise of water can be easily made. Thus, the construction work can be done even during a flooding period.

Furthermore, a reinforcement wall for preventing a slip destruction of an already existing embankment (either one or both of a main portion and a foundation portion) can be built.

In this case, as compared with a case where a vertical wall is built, since the weight of the wall acts against a slip load (earth pressure), a high slip destruction preventing effect can be obtained.

A roof and/or a floor for preventing the entry of water into an underground stockroom can be efficiently built with a fewer number of construction steps.

In this case, conical and inverted conical continuous walls can be built at the upper and lower side with the apices thereof in contact with each other, and the lower continuous wall can be used as a water cutoff bottom wall for pit excavation or an underground roof for an underground stockroom.

The angle of the chain cutter (excavation angle) can be desirably adjusted by the backstay according to the application of the continuous wall.

In this case, if the hydraulic cylinder is used as the backstay the angle adjustment can be easily and quickly performed.

BEST MODES FOR CARRYING OUT THE INVENTION

Embodiments of the invention are described with reference to the accompanying drawings.

Figure 1:
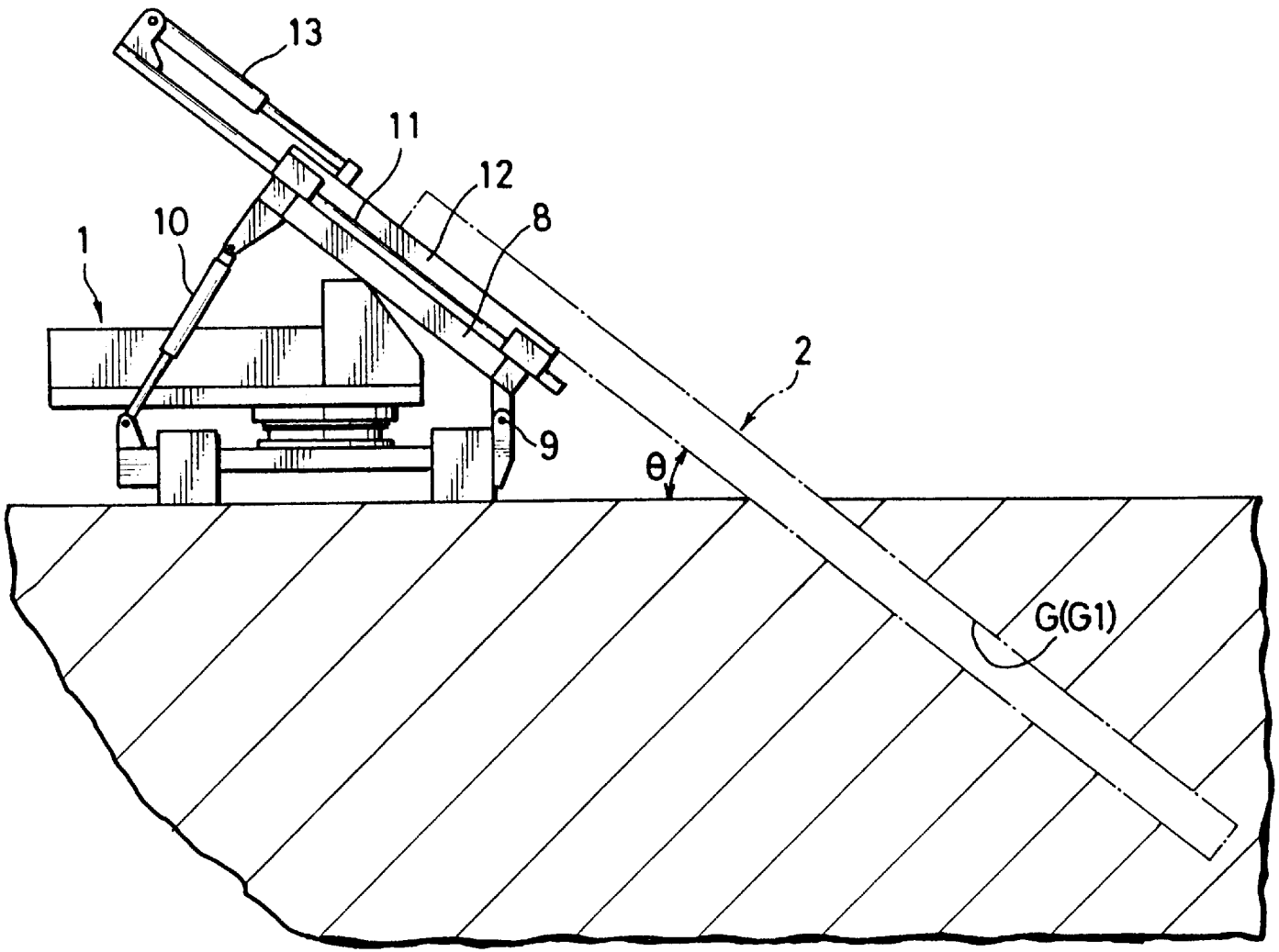
FIG. 1 is a side view showing the overall construction of an excavator as a building apparatus according to one embodiment of the invention.

FIG. 1 shows an overall construction of an excavator (continuous wall building apparatus) for excavating a continuous trench which serves as a base of an underground continuous wall.

This excavator is basically constructed such that a chain cutter 2 is mounted on a running carriage (e.g. a base machine of a crawler crane) 1 capable of running by itself. A continuous trench G of specified length is excavated by moving the cutter 2 in a transverse direction while rotating it with the cutter 2 placed in a hole dug by a suitable means such as a hydraulic shovel.

Figure 2:
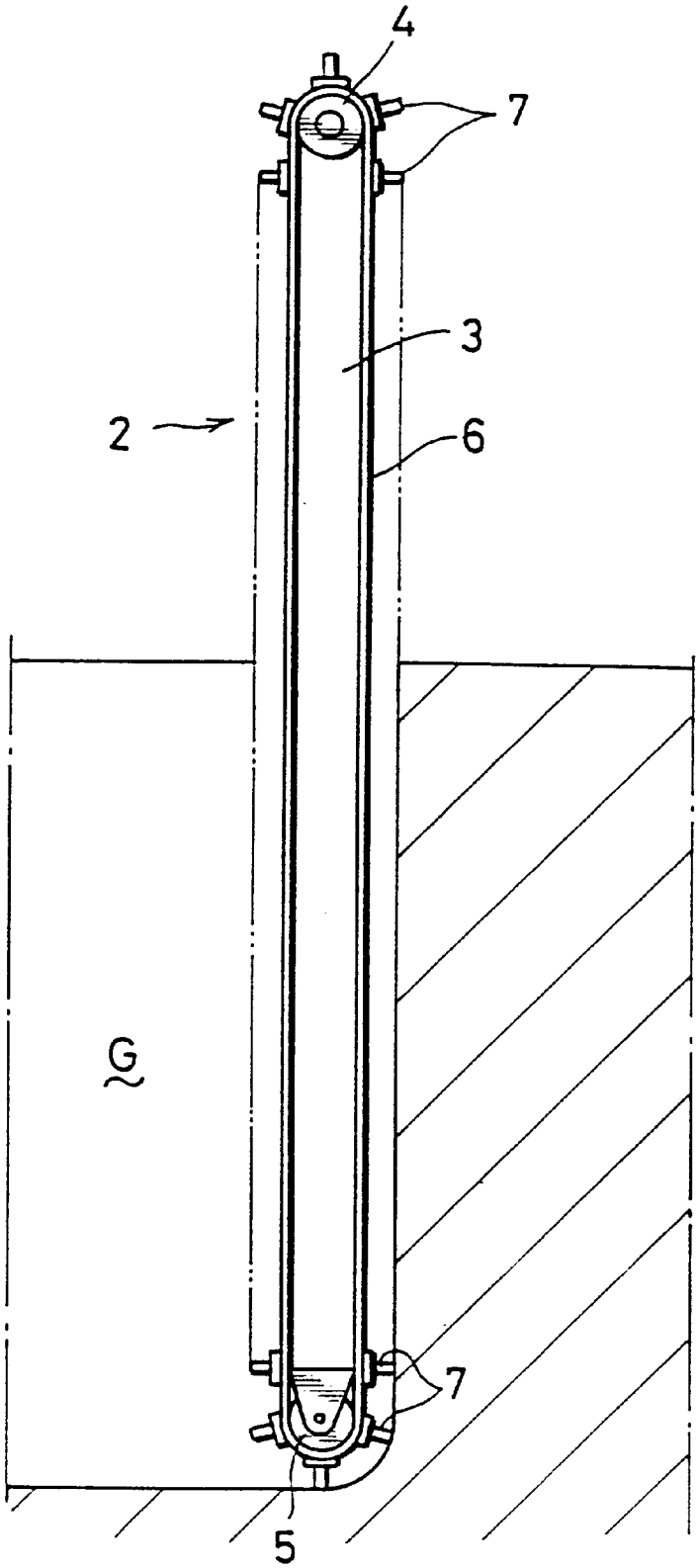
FIG. 2 is a front view of a chain cutter of the excavator.

The cutter 2 is, as shown in FIG. 2, constructed such that an endless chain 6 is fitted between a drive wheel (sprocket) 4 provided at an upper end of a cutter post 3 which is a vertically long boxlike frame and a driven wheel (pulley) 5 at a bottom end thereof and a multitude of excavation blades 7 are provided on the outer surface of the chain 6 to excavate the trench G.

The cutter 2 is mounted on the running carriage 1 as follows.

As shown in FIG. 1, a main frame 8 is mounted on the running carriage 1.

This main frame 8 has its bottom and upper ends supported on the running carriage 1 via a horizontal shaft 9 and an expandable backstay 10 comprised of a hydraulic cylinder, respectively. The main frame 8 is inclinable about the horizontal shaft 9 according to the expansion and contraction of the backstay 10, i.e. an inclination (θ) thereof with respect to a horizontal plane is adjustable.

A leader 11 and a slide frame 12 are mounted on the front surface of the main frame 8 and on the upper end of the cutter 2 (cutter post 3), respectively. This slide frame 12 is movably mounted on the leader 11 upward and downward.

Identified by 13 is a hydraulic cylinder provided between the leader 11 and the slide frame 12 to move the slide frame 12 upward and downward. The slide frame 12 (cutter 2) moves upward and downward as the cylinder 13 expands and contracts, thereby adjusting an excavation depth.

In this way, the excavator is constructed, such that the cutter 2 is obliquely mounted on the running carriage 1 and the inclination (θ) thereof is adjustable.

Next, there is described methods according to which a continuous trench is excavated using this excavator and a variety of underground continuous walls are built on the basis of this excavated continuous trench.

A. Repair of an Underground Stockroom for Radioactive Wastes (see FIGS. 1, 3 to 5)

If an underground stockroom 14 for radioactive wastes as an underground construction becomes decrepit, there is a likelihood that radioactive components leak to the ground surface by being mixed in rainwater.

Accordingly, in order to prevent this leakage, a repair roof is constructed above the stockroom 14 in the following procedure.

(1) First, as shown in FIG. 1, the running carriage 1 of the excavator is so placed as to be movable in a transverse direction in parallel with a roof building schedule line where the roof is to be built. A slanting first continuous trench G1 is excavated by moving the running carriage 1 while rotating the cutter 2 with the cutter 2 placed in the ground (in a slanting long hole dug in advance by a suitable means) as described above.

The inclination of this continuous trench G1 (inclination (θ) of the cutter 2) is adjusted by the backstay 10 according to the width of the stockroom 14 or the like.

Figure 3:
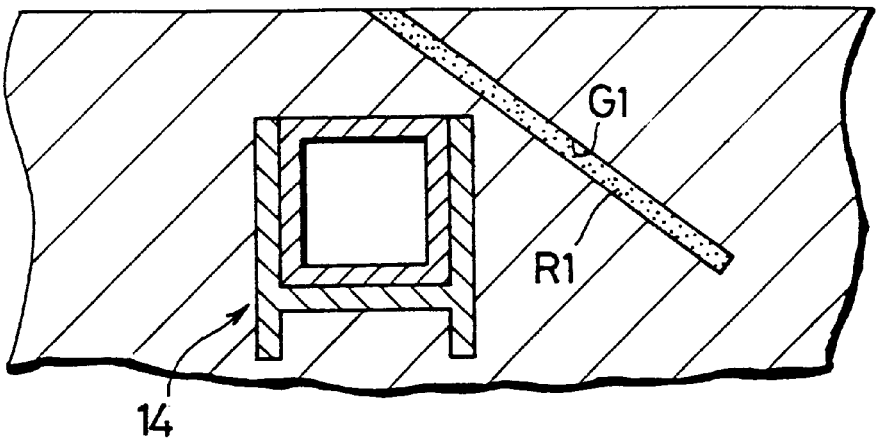
FIG. 3 is a portion of a first roof wall built according to a method for building a repair roof of a radioactive waste stockroom as a first variation of a continuous wall building method using the above excavator.

(2) After the excavation of this trench, a water cutoff material is poured into the trench G1 and solidified therein, thereby building a slanting roof wall (first roof wall) R1 at one side as shown in FIG. 3.

Figure 4:
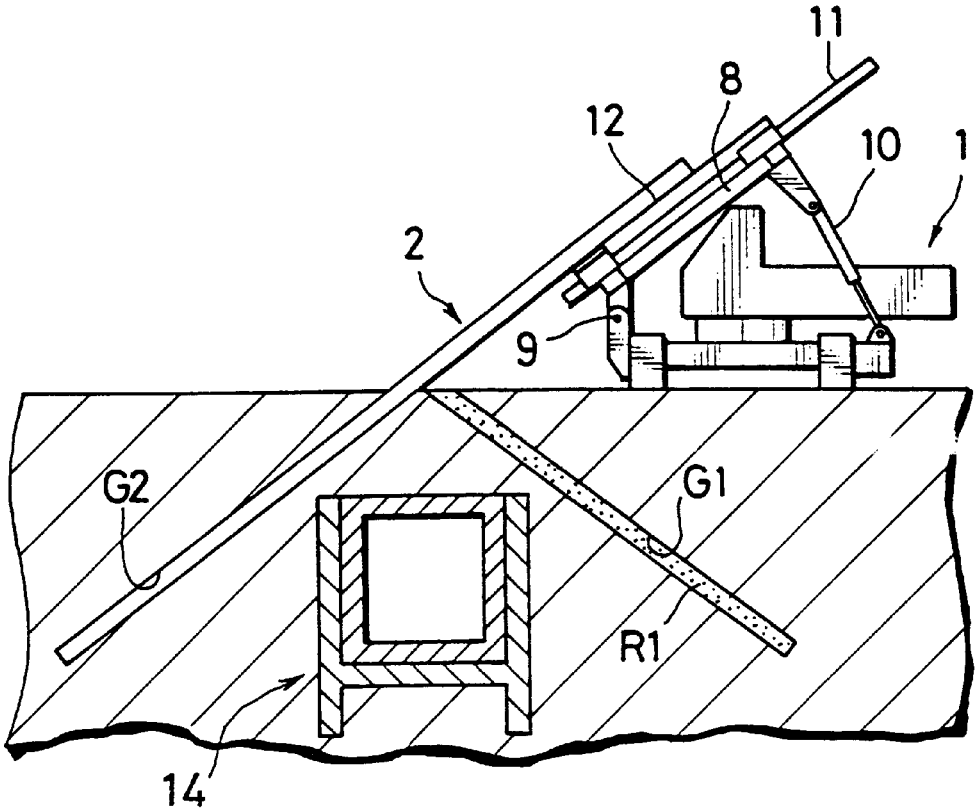
FIG. 4 is a section showing a state where a second continuous trench is excavated according to the above method.

(3) After or before the solidification of the first roof wall R1, the excavator is transferred to an opposite side with respect to the center of the roof building schedule line as shown in FIG. 4 and a slanting second continuous trench G2 is so excavated as to be extend in a direction opposite to the extension of the first roof wall R1.

Figure 5:
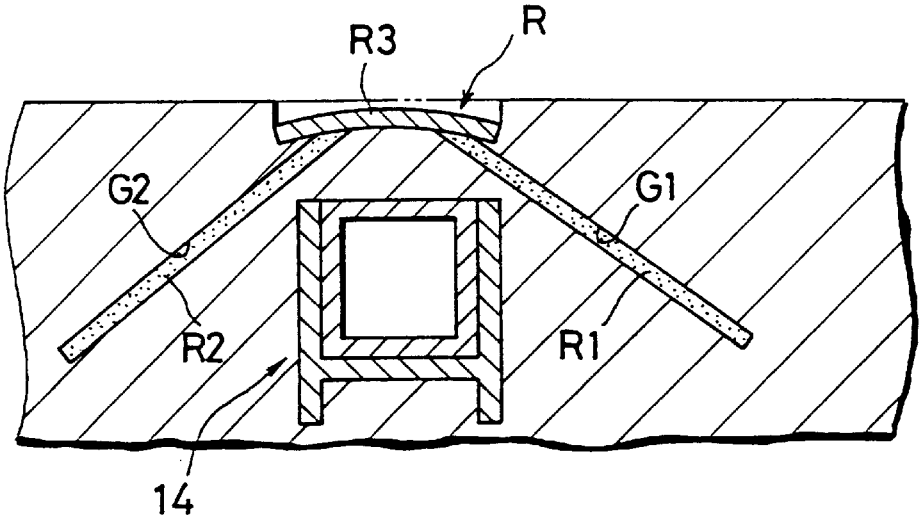
FIG. 5 is a section of a roof completed according to the above method.

(4) Similar to the building of the first roof wall R1, a water cutoff material is poured into the excavated continuous trench G2 and solidified therein, thereby building a second roof wall R2 as shown in FIG. 5.

(5) In order to fill up a clearance between the upper ends of the both roof walls R1, R2 which were built substantially into an inverted V-shape, the ground surface is slightly dug; a roof presser R3 is built of solidified bentonite or like material having a good water cutoff property; and the ground is filled up.

It should be noted that the roofs R1, R2 can be so built as to cross. In such a case, the roof presser R3 is not necessary.

In this way, the roof R of the stockroom 14 can be easily built at the ground surface side at a reduced cost and for a short time, thereby preventing the leakage of radioactive components to the ground surface.

Figure 6:
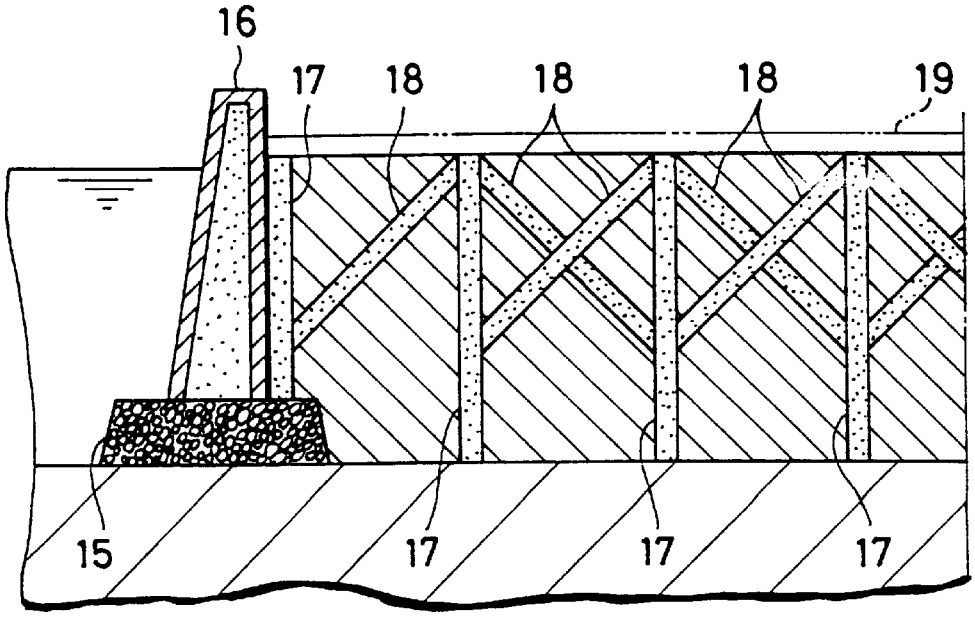
FIG. 6 is a section showing a state where a reinforcement for a bank wall is built as a second variation.

B. Reinforcement of a Bank Wall (see FIG. 6)

After a land side of a caisson 16 installed on a riprap mound 15 is reclaimed, a construction work is done to reinforce the ground of a reclaimed area.

(1) A vertical reinforcement wall 17 is built on the rear surface of the caisson 16.

The vertical reinforcement wall 17 can be built by, after a continuous trench is excavated by the excavator in which the cutter 2 shown in FIGS. 1 and 2 is vertically mounted on the running carriage 1, pouring a solidifying solution into the continuous trench and solidifying it therein.

(2) Behind the vertical reinforcement wall 17, a slanting continuous trench is excavated using the excavator of FIG. 1, and an oblique wall 18 is built by pouring a solidifying solution into the continuous trench and solidifying it therein.

(3) A vertical reinforcement wall 17 is built behind this oblique wall 18.

After an underground reinforcement is constructed by successively building the vertical reinforcement walls 17 and the oblique walls 18 within a specified area, a paved road 19 is built on the ground surface.

The oblique wall 18 may be comprised of a single wall obliquely extending between the vertical reinforcement walls 17 or two crosswise intersecting walls.

By building the oblique walls 18 between vertical reinforcement walls 17, the strength of the underground reinforcement can be considerably enhanced and, particularly, a highly earthquake-resistant bank wall can be built.

C. Water Cutoff during the Construction of a Common Trench (see FIG. 7)

In the case that a common trench 20 of concrete or like material for accommodating wires and pipes such as gas pipes, electric wires, water pipes and sewage pipes is built in the ground, since there is a likelihood of submergence from below during the excavation of the trench in a place where free-water elevation is high, a cutoff bottom wall needs to be built below the common trench 20.

In this case, there has been conventionally adopted a time and labor consuming method for building vertical walls up to an impermeable bed at the opposite sides of the common trench.

Contrary to this, if a building method according to the invention is adopted, after vertical walls 21 are built at the opposite sides of the common trench 20, a slanting continuous trench is so excavated as to extend over the two vertical walls 21 and a solidifying solution is poured thereinto and solidified therein. In this way, a slanting cutoff bottom wall 22 can be easily built at a reduced cost and for a short time.

D. Prevention of the Liquefaction of the Ground (FIG. 8)

The liquefaction of the ground can be prevented by preventing the gushing of groundwater.

Figure 8:
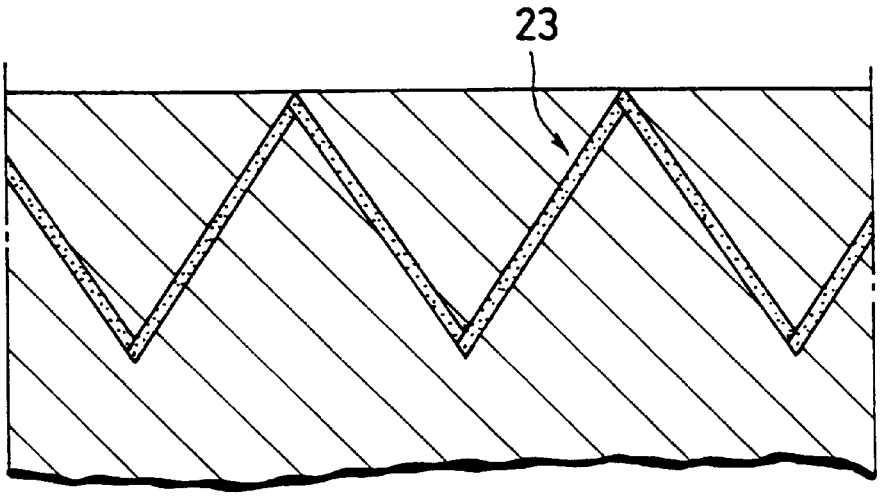
FIG. 8 is a section showing a state where a liquefaction prevention ground is built as a fourth variation.

Accordingly, as shown in FIG. 8, slanting continuous trenches are continuously excavated in a zigzag manner in the ground which is likely to experience a liquefaction. A zigzag continuous cutoff wall 23 is built by pouring a solidifying solution into the zigzag trench and solidifying it therein. A liquefaction prevention ground which is cut off from groundwater is built over a wide range above the continuous cutoff wall 23.

E. Conservancy of River and Sea Banks (Hereafter, Description is Made Taking a River Bank as an Example)

E-1 Construction of a Bank Protection Wall Conventionally, a construction work for the protection of a bank to stop a washout (erosion of the river bank) has been generally done by a following technique.

(a) A poling board is placed in water near the river bank to dam up the water, thereby performing a so-called coffering.

(b) After the water at the land side with respect to the poling board is pumped out, the slope of the river bank is reformed.

(c) Concrete is deposited on the bank surface including the slanting surface thereof to consolidate the foundation.

(d) After the concrete surface at the slope is covered with soil or earth, the poling board is removed.

However, according to this technique, since the natural bank slope is worked, it cannot meet a recent demand for remaining natural views.

Further, many construction steps of this technique leads to a poor construction efficiency and a higher cost.

Furthermore, the river is dammed up and the construction work is done at the outside of the river bank, it is difficult to quickly evacuate at the time of the rise of water. Thus, no construction work is normally possible during a flooding period (June through November).

Figure 9:
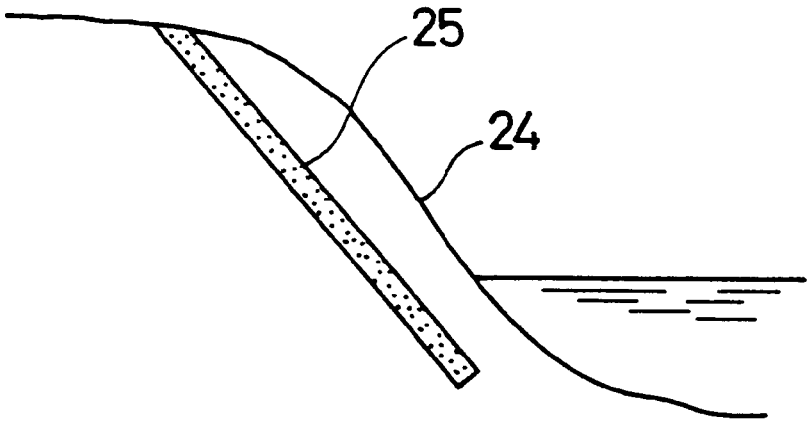
FIG. 9 is a section showing a state where a bank protection wall is built as a fifth variation.

Accordingly, as shown in FIG. 9, a slanting continuous trench is excavated in the river bank along a natural bank slope 24, and a slanting bank protection wall 25 is built along the bank by pouring a solidifying solution into this continuous trench and solidifying it therein.

According to this technique, since it is not necessary to work the natural bank slope 24 and the bank protection wall 25 is concealed in the ground, natural views can be maintained.

Figure 10:
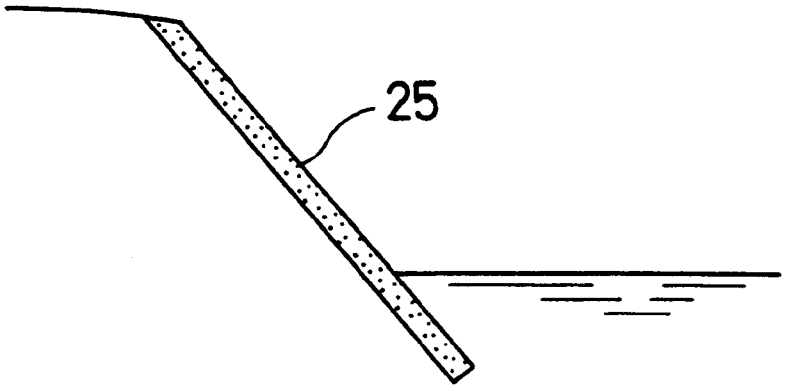
FIG. 10 is a section showing a state where the bank protection wall has been washed out to be exposed to the outside.

Further, even if the bank slope 24 is washed out to expose the bank protection wall 25 as shown in FIG. 10, since the bank protection wall 25 is slanting, the bank is allowed to have a bank slope which is very similar to the original bank slope 24.

In addition, since the construction work can be done on the bank and it is not necessary to dam up the river, evacuation at the time of the rise of water can be easily made. Thus, the construction work can be made possible even during a flooding period.

E-2 Countermeasure against the Leakage of Already Existing Embankments

In the case that an embankment itself or its foundation portion is a permeable bed, there is a likelihood that river water permeates through this permeable bed and leaks to the land side.

In such a case, a labor and cost consuming technique has been conventionally adopted: a cutoff wall is built on the bank slope at the river side in the case that the embankment itself is a permeable bed, whereas a poling board for water cutoff purpose is placed in the case that the foundation portion is a permeable bed.

Figure 11:
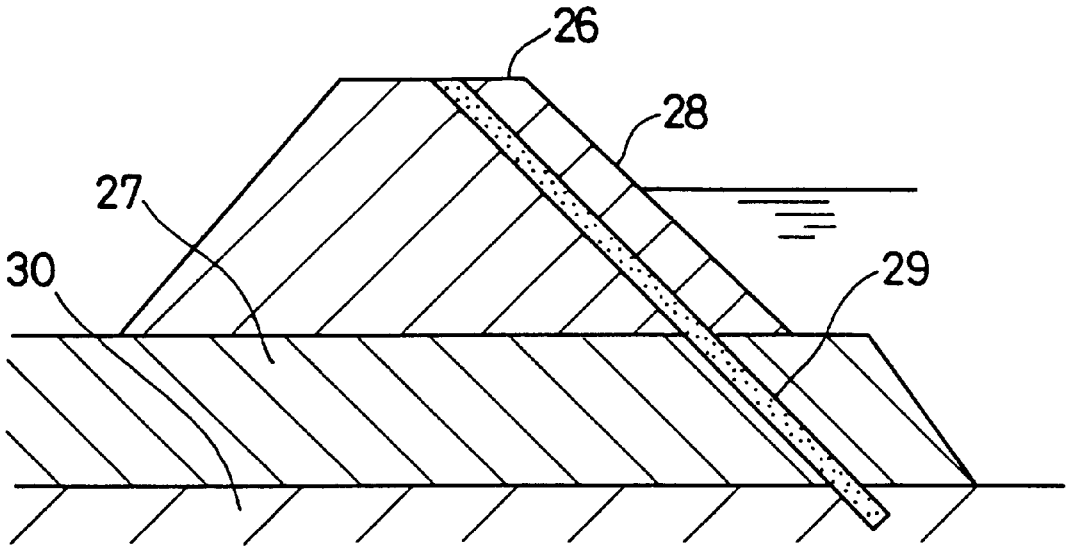
FIG. 11 is a section showing a state where a cutoff wall is built to prevent the leakage from a river side to a land side as a sixth variation.

Accordingly, as shown in FIG. 11, in the case that a foundation portion 27 of an embankment 26 (or the embankment itself) is a permeable bed, a slanting continuous trench is excavated along a bank slope 28 on the embankment, and a slanting cutoff wall 29 is built by pouring a solidifying solution into this trench and solidifying it therein. Identified by 30 is an impermeable bed.

According to this technique, a construction work for preventing the leakage from the river side to the land side can be efficiently performed with a fewer number of construction steps and at a reduced cost.

E-3 Reinforcement of an Already Existing Embankment

Figure 12:
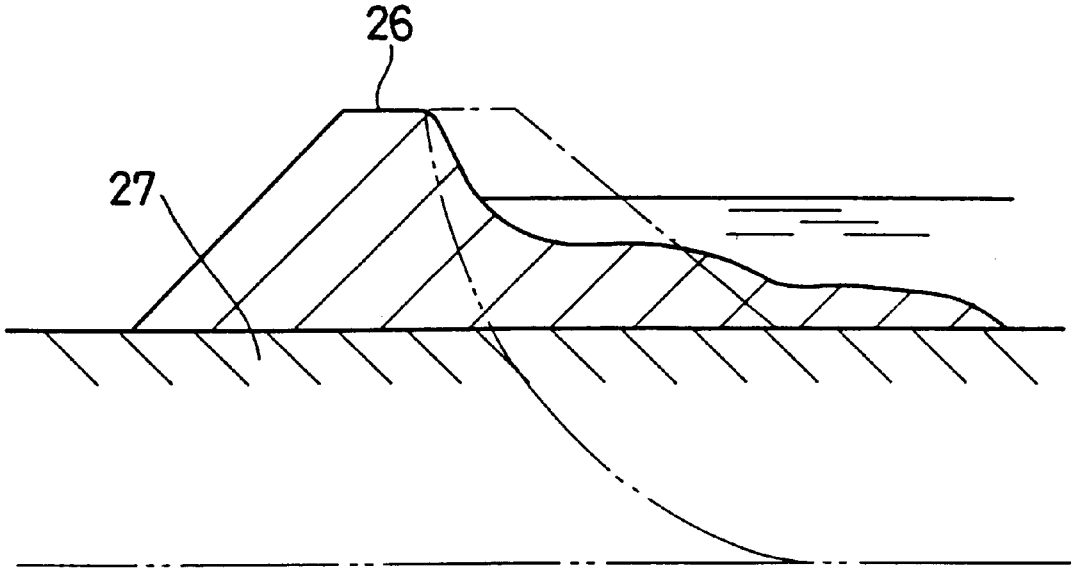
FIG. 12 is a section showing a state of a slip destruction of an embankment.

As shown in FIG. 12, slip destruction occurs when the embankment 26 is weak. Further, if the embankment 26 and the foundation portion 27 are both weak, slip destruction occurs, extending over the both as indicated by phantom line in FIG. 12.

Figure 13:
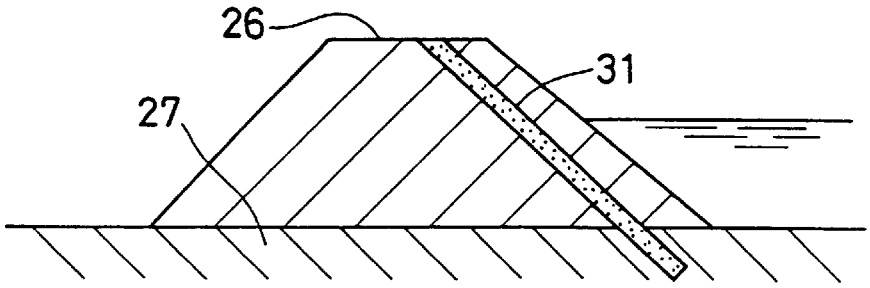
FIG. 13 is a section showing a state where a reinforcement wall is built in an embankment to prevent this slip destruction.
Figure 14:
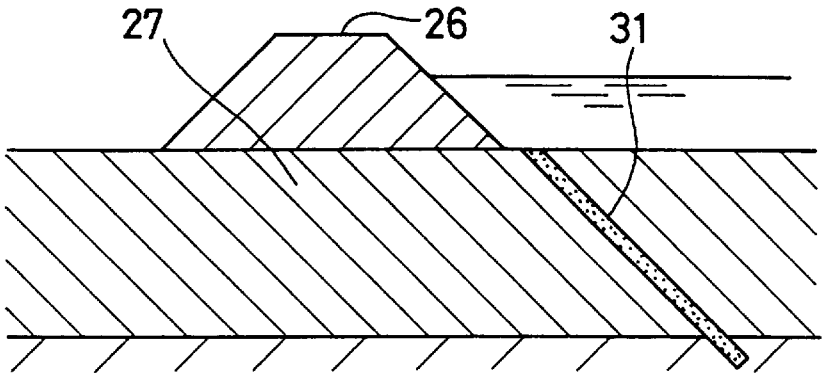
FIG. 14 is a section showing a state where a reinforcement wall is built in a foundation portion of the embankment.
Figure 15:
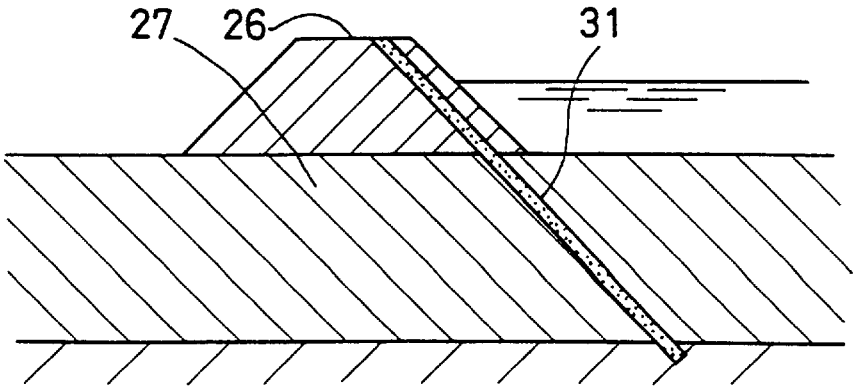
FIG. 15 is a section showing a state where a reinforcement wall is so built as to extend over the embankment and its foundation portion.

In order to prevent such a slip destruction, a slanting reinforcement wall 31 is built in the embankment 26 as shown in FIG. 13, or in the foundation portion 27 as shown in FIG. 14, or over the embankment 26 and the foundation portion 27 as shown in FIG. 15.

In such a case, as compared with the vertical reinforcement wall, a leaning wall effect: the weight of the slanting reinforcement wall 31 acts against the earth pressure, can be obtained, thereby enhancing a reinforcing function and a slip destruction preventing effect.

F. Another Examples of Vertical Water Cutoff Technique

Figure 7:
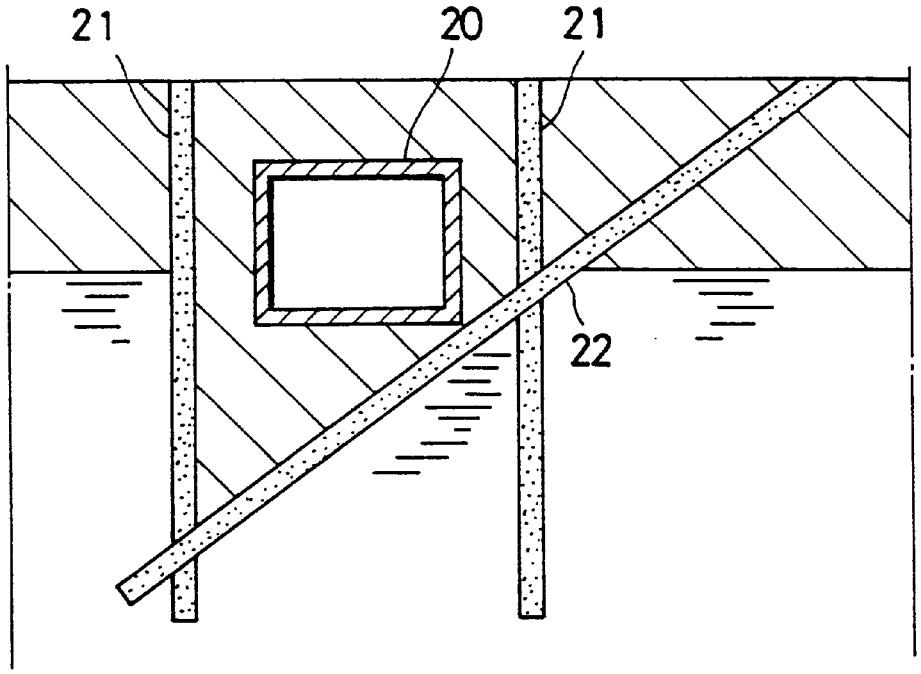
FIG. 7 is a section showing a state where a lower cutoff wall is built at the time of building a common trench as a third variation.

According to the vertical water cutoff techniques shown in FIGS. 7 and 8, the slanting cutoff walls 22, 23 are linearly built. Accordingly, in the case that an area is desired to be enclosed by cutoff walls, vertical walls need to be built at the opposite sides with respect to the widthwise directions of the cutoff walls 22, 23. In other words, there is a disadvantage that the cutoff walls cannot be continuously built.

In view of the above, following techniques may be adopted.

Figure 16:
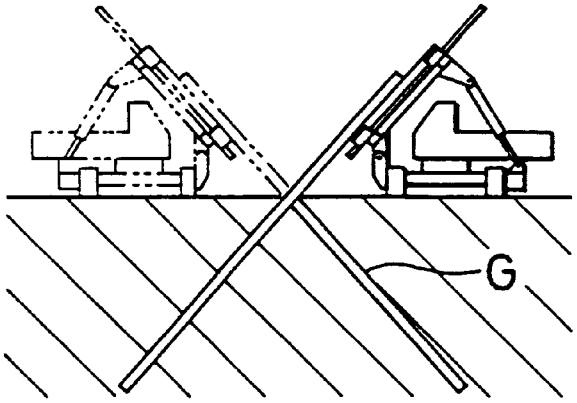
FIG. 16 is a section showing a state where a conical continuous trench is excavated in the ground as a method for building a conical cutoff roof in the ground as a seventh variation.
Figure 17:
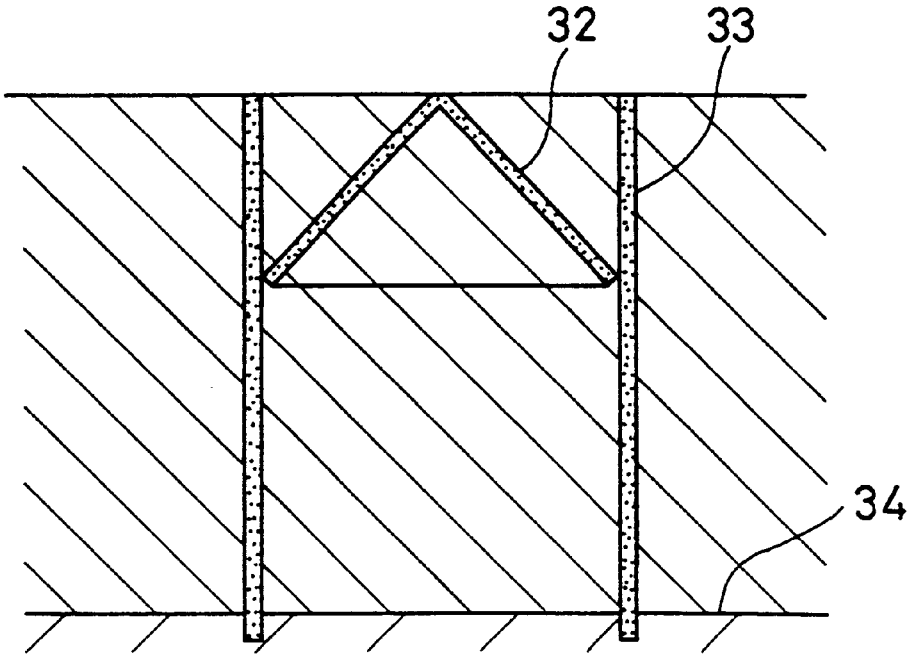
FIG. 17 is a section showing a state where a conical cutoff roof and a cylindrical side wall are built according to the above method.

(I) In the case that a stockroom for compressed air or the like is constructed in the ground, a conical continuous trench G is excavated by moving the excavator in circle on the ground with a contact point of the cutter 2 with the ground surface as a fixed point as shown in FIGS. 16 and 17. By pouring a solidifying solution into this trench G and solidifying it therein, a conical cutoff roof 32 is built.

As shown in FIG. 17, a cylindrical side wall 33 is built around the cutoff roof 32 up to an impermeable bed 34. The underground stockroom is constructed by removing earth and sand between the cutoff roof 3, the side wall 33 and the impermeable bed 34 and connecting the cutoff roof 32 and the side wall 33.

Figure 18:
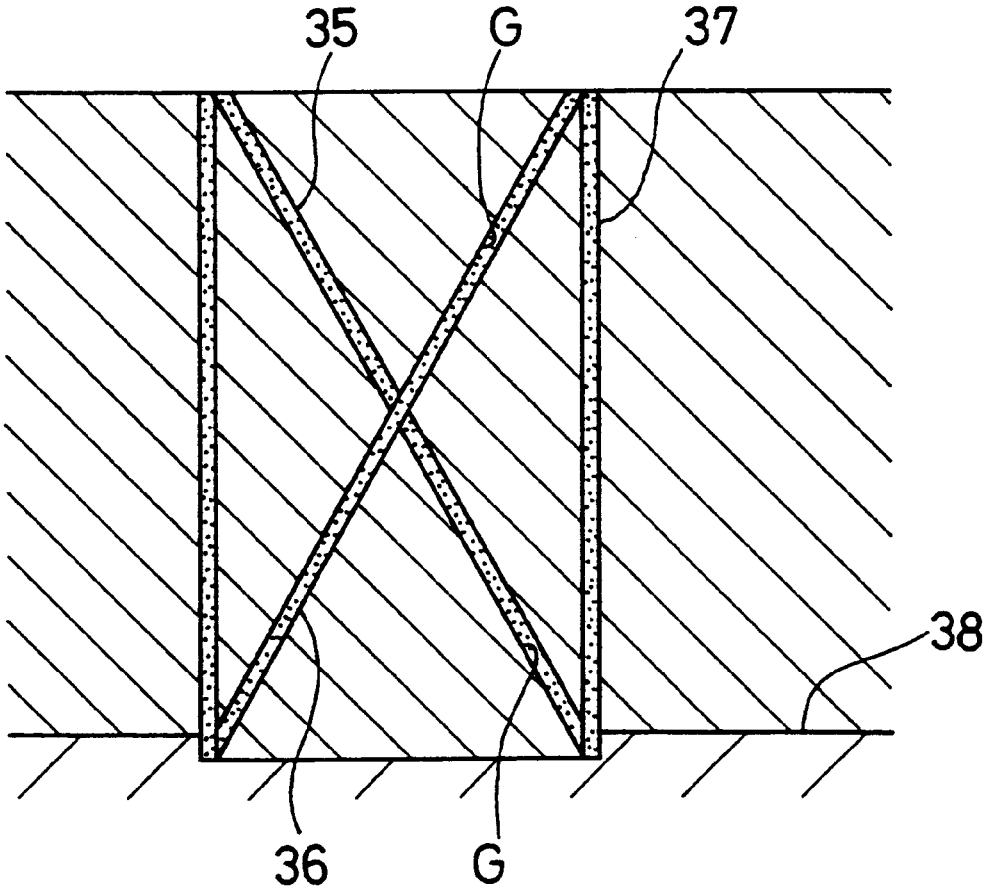
FIG. 18 is a section showing a state where an inverted conical continuous wall and a conical continuous wall are built at upper and lower sides of the underground as a method for building a conical cutoff bottom wall in the ground as an eighth variation.

(II) In the case that a cutoff bottom wall is built at the time of pit excavation, the excavator is moved in circle on the ground with an intermediate point of a portion of the cutter placed in the ground as a fixed point, thereby excavating an inverted conical and a conical continuous trenches G at upper and lower sides of the underground, respectively, with their apices in contact with each other as shown in FIG. 18. A solidifying solution is poured into these trenches G and solidified therein, thereby building an inverted conical and a conical continuous walls 35, 36 at the upper and lower sides, respectively.

After or before this operation, a cylindrical side wall 37 is built up to an impermeable bed 38.

Figure 19:
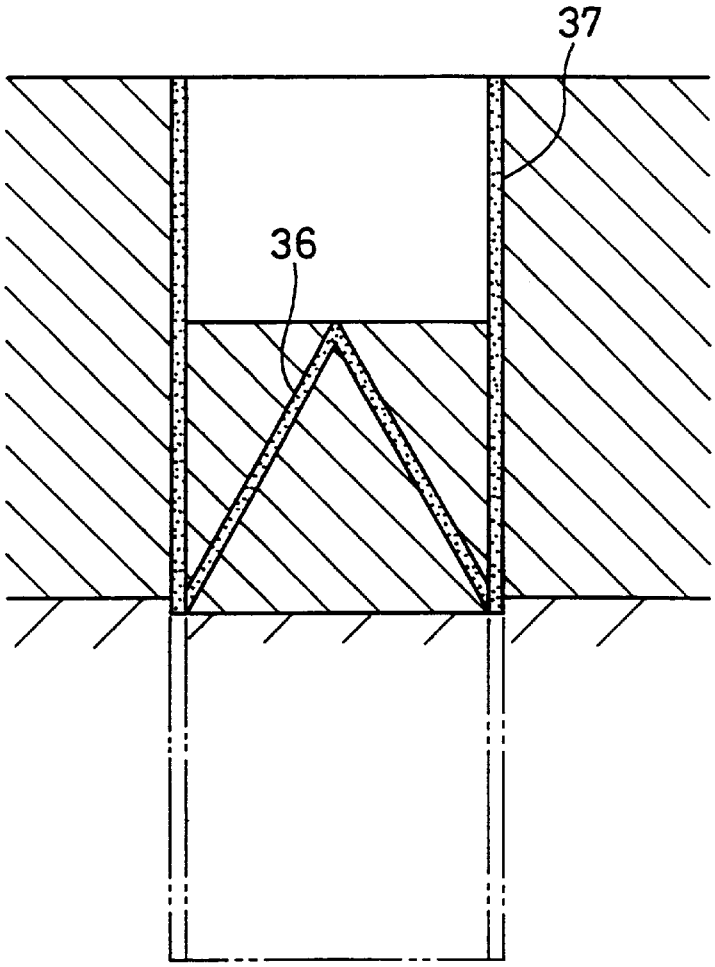
FIG. 19 is a section showing a state where pit excavation is performed with a conical continuous wall used as a cutoff bottom wall according to the above method.

Thereafter, as shown in FIG. 19, pit excavation is performed for an area enclosed by the side wall 37 with the lower side conical continuous wall 36 used as a cutoff bottom wall.

It should be noted that this technique may also be used as a technique for constructing an underground stockroom deep in the underground by building the side wall 37 deeper than the lower side conical wall 36 and using the conical wall 36 as a cutoff roof as indicated by phantom line in FIG. 19.

Figure 20:
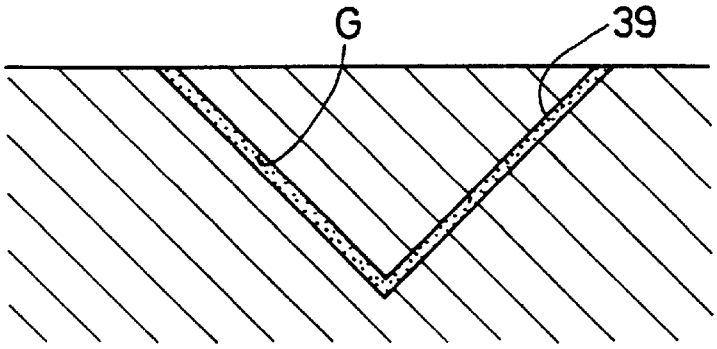
FIG. 20 is a section showing a state where a cutoff bottom wall for a pit excavation area or liquefaction prevention area is built in the ground as a ninth variation.

(III) By moving the excavator in circle with the bottom end of the portion of the cutter placed in the ground as a fixed point, an inverted conical continuous trench G is excavated as shown in FIG. 20. A solidifying solution is poured into this trench G and solidified therein. In this way, a cutoff bottom wall 39 for a circular pit excavation area or liquefaction prevention area can be efficiently continuously built.

In the foregoing embodiments, the solidifying solution (cement slurry) is poured into the excavated continuous trench and mixed with the soil available in the original position to build a continuous wall of soil cement. However, concrete may be poured into the excavated trench and solidified therein to build a concrete continuous wall.

Alternatively, the continuous wall may be built by inserting panels of steel or concrete into the excavated continuous trench while connecting them in a transverse direction.

The present invention is widely applicable to a variety of purposes other than those mentioned in the foregoing embodiments.

On the other hand, in the building apparatus (excavator), the backstay 10 is constructed by a hydraulic cylinder and the inclination is adjusted by expanding and contracting this hydraulic cylinder in the foregoing embodiments. However, the backstay 10 may be telescopically constructed merely by an inner tube and an outer tube and the inclination may be adjusted with the help of a crane or like lifting apparatus.

Industrial Application

As described above, according to the present invention, the slanting continuous trench is excavated by obliquely mounting the chain cutter provided with excavation blades on the running carriage and moving the running carriage in the transverse direction while rotating the cutter with the cutter obliquely placed in the ground, and the wall material is poured into this excavated trench, thereby building the slanting continuous wall in the ground. Accordingly, the application of the continuous walls can be expanded such as the use as a cutoff wall having a water cutoff function along vertical direction.

In this case, the continuous wall can be built as the repair roof of the underground construction such as a stockroom for radioactive wastes.

The continuous wall may be built as an oblique wall of an underground reinforcement in, e.g. a highly earthquake-resistance quay.

Further, the continuous wall can be built as a water cutoff bottom wall for preventing the entry of groundwater into a trench excavated, e.g. to build a common trench in the ground where free-water elevation is high.

On the other hand, the continuous wall can be built as a continuous cutoff wall, e.g. in the case that a ground liquefaction prevention area is built over a wide range.

Protection walls for banks of rivers or other watercourses, walls for preventing a leakage in the already existing embankments, and reinforcement walls for preventing a slip destruction can be efficiently built with a fewer number of construction steps.

A bank protection wall for preventing a washout (erosion) can be built while maintaining a natural view by keeping a bank slope intact.

Even if the bank is washed out to expose the wall, since the wall is slanting, the bank can be kept as natural as possible.

Since a construction work can be done on the bank and a so-called coffering where the water of the river or the like is dammed up to enable a construction work on the inside of the bank is not necessary, evacuation at the time of the rise of water can be easily made. Thus, the construction work can be done even during a flooding period.

Further, the reinforcement wall for preventing a slip destruction of the already existing embankment (either one or both of the main portion and the foundation portion) can be built.

In this case, as compared with a case where a vertical wall is built, since the weight of the wall acts against a slip load (earth pressure), the slip destruction preventing effect can be improved.

The roof and the floor for preventing the entry of water into the underground stockroom can be efficiently built with a fewer number of construction steps.

In this case, the inverted conical and conical continuous walls are built at the upper and lower side with the apices thereof in contact with each other, and the lower continuous wall can be used as a cutoff bottom wall for pit excavation or an underground roof for an underground stockroom.

The angle of the chain cutter (excavation angle) can be desirably adjusted by a backstay according to the application of the continuous wall.

In this case, if the hydraulic cylinder is used as the backstay, the angle adjustment can be easily and quickly performed.

What is claimed is:

1. A method for building an underground continuous wall, comprising the steps of:

placing a chain cutter carried by a running carriage obliquely in ground by sliding the chain cutter in an oblique direction by a hydraulic cylinder;

moving the running carriage along a specified course over the ground, said running carriage carrying the chain cutter fixedly held in the oblique direction in the ground, said chain cutter being driven to form a first continuous slanting trench and a second continuous oppositely slanting trench;

excavating the first and the second continuous slanting trenches so as to form an inverted V cross section separated at an apex thereof;

pouring a wall material into the first and second continuous trenches in order to build two continuous walls with an inverted V cross section; and placing a slightly arcuate roof bridging the apex of the two continuous walls with the inverted V cross section above an underground construction.

2. A method for building an underground continuous wall, comprising the steps of:

placing a chain cutter carried by a running carriage obliquely in ground by sliding the chain cutter in an oblique direction by a hydraulic cylinder;

moving the running carriage along a specified course over the ground, said running carriage carrying the chain cutter fixedly held in the oblique direction in the ground, said chain cutter being driven to form a first continuous slanting trench and a second continuous crossing trench;

building a plurality of vertical walls in the ground;

excavating the first continuous slanting trench and the second continuous crossing trench between the vertical walls built in the ground; and pouring a wall material into the first and second continuous trenches in order to build a X-shaped wall for reinforcement between the vertical walls.

3. A method for building an underground continuous wall, comprising the steps of:

placing a chain cutter carried by a running carriage obliquely in ground by sliding the chain cutter in an oblique direction by a hydraulic cylinder;

moving the running carriage along a specified course over the ground, said running carriage carrying the chain cutter fixedly held in the oblique direction in the ground, said chain cutter being driven to form a continuous slanting trench;

building two vertical walls at a specified spacing in the ground;

undercutting at an angle and then excavating the continuous slanting trench so as to extend underneath the two vertical walls; and pouring a wall material into the continuous trench in order to build a slanting continuous cutoff bottom wall for preventing entry of water from below into a region between the two vertical walls.

4. A method for building an underground continuous wall, comprising the steps of:

placing a chain cutter carried by a running carriage obliquely in ground by sliding the chain cutter in an oblique direction by a hydraulic cylinder;

moving the running carriage along a specified course over the ground, said running carriage carrying the chain cutter fixedly held in the oblique direction in the ground, said chain cutter being driven to form a continuous slanting trench;

excavating the continuous slanting trench in a zigzag manner; and pouring a wall material into the continuous trench in order to build a slanting zigzag continuous cutoff wall.

5. A method for building an underground continuous wall, comprising the steps of:

placing a chain cutter carried by a running carriage obliquely in ground by sliding the chain cutter in an oblique direction by a hydraulic cylinder;

moving the running carriage along a specified course over the ground, said running carriage carrying the chain cutter fixedly held in the oblique direction in the ground, said chain cutter being driven to form a continuous slanting trench;

pouring a wall material into the continuous slanting trench to build a continuous wall under the ground;

excavating the continuous slanting trench along a bank; and pouring a wall material into the continuous trench in order to build a slanting continuous wall along the bank.

6. The method according to claim 5, wherein said step of excavating is carried out along a base slope of a natural bank.

7. The method according to claim 5, wherein said step of excavating is carried out through at least one of a first top main portion and a second bottom foundation portion of an embankment build along the bank.

8. A method for building an underground continuous wall, comprising the steps of:

placing a chain cutter carried by a running carriage obliquely in ground by sliding the chain cutter in an oblique direction by a hydraulic cylinder;

moving the running carriage along a specified course over the ground, said running carriage carrying the chain cutter fixedly held in the oblique direction in the ground, said chain cutter being driven to form a continuous slanting trench;

building two vertical walls in the ground;

excavating a conical continuous trench by moving the running carriage in a circle between the two vertical walls; and pouring a wall material into the continuous trench in order to build a conical continuous cutoff wall between the two vertical walls.

9. The method according to claim 8, further comprising the steps of:

excavating an inverted conical continuous trench above the conical continuous trench by moving the running carriage in a circle with an intermediate point of a portion of the cutter placed in the ground and set as a fixed point; and pouring the wall material into the inverted conical continuous trench in such a manner that apices of the respective conical continuous trenches are in contact with each other.

* * * * *

UNITED STATES PATENT AND TRADEMARK OFFICE

CERTIFICATE OF CORRECTION

PATENT NO. : 6,139,225
DATED : October 31, 2000
INVENTOR(S) : Kenji Koike, et al.

It is certified that error appears in the above-identified patent and that said Letters Patent is hereby corrected as shown below:

On the Title page, Item [73], the Assignee information is incomplete.
Item [73] should read as follows:

--- [73] Assignees: Kabushiki Kaisha Kobe Seiko Sho, Kobe; Japan as represented by A General Manager, Kanto Regional Construction Bureau, Ministry of Construction, Tokyo-to; both of Japan ---

Signed and Sealed this

Nineteenth Day of June, 2001

*Attest:*

Nicholas P. Godici

*Attesting Officer*

NICHOLAS P. GODICI
*Acting Director of the United States Patent and Trademark Office*